US007469490B2

(12) United States Patent
Tang

(10) Patent No.: US 7,469,490 B2
(45) Date of Patent: Dec. 30, 2008

(54) ADJUSTING DEVICE USED TO ADJUST SIZE OF SLIDING SPORTS SHOE

(76) Inventor: Guoqiang Tang, No. 3 Lane 6, Anbu Street, Daliang Town, Shunde District, Foshan City (CN) 528322

( * ) Notice: Subject to any disclaimer, the term of this patent is extended or adjusted under 35 U.S.C. 154(b) by 361 days.

(21) Appl. No.: 11/326,601

(22) Filed: Dec. 30, 2005

(65) Prior Publication Data

US 2006/0201033 A1 Sep. 14, 2006

(30) Foreign Application Priority Data

Dec. 31, 2004 (CN) ..... 2004 1 0077763

(51) Int. Cl.
*A43B 3/26* (2006.01)

(52) U.S. Cl. ..... 36/97

(58) Field of Classification Search ..... 36/97, 36/7.3, 7.5, 7.6, 102; 280/11.26
See application file for complete search history.

(56) References Cited

U.S. PATENT DOCUMENTS

| | | | | |
|---|---|---|---|---|
| 5,813,146 | A * | 9/1998 | Gutkowski et al. | 36/97 |
| 6,138,385 | A * | 10/2000 | Jungkind et al. | 36/97 |
| 6,807,754 | B2 * | 10/2004 | Miller et al. | 36/97 |
| 6,918,601 | B2 * | 7/2005 | Sauter et al. | 280/11.26 |

FOREIGN PATENT DOCUMENTS

| | | |
|---|---|---|
| CN | 2510119 Y | 9/2002 |

* cited by examiner

*Primary Examiner*—Ted Kavanaugh
(74) *Attorney, Agent, or Firm*—Perkins Coie LLP

(57) ABSTRACT

This invention discloses an adjusting device used to adjust the size of a sliding sports shoe, which is composed of an adjusting member for shoe size and a driving spring. With this adjusting device the size of a sliding sports shoe can be adjusted in a step manner by pressing directly a button on its side and can be automatically locked by itself.

11 Claims, 4 Drawing Sheets

ADJUSTING DEVICE USED TO ADJUST SIZE OF SLIDING SPORTS SHOE

CROSS-REFERENCE TO RELATED APPLICATION

This application claims priority to Chinese Application No. 200410077763.2, filed Dec. 31, 2004, the disclosure of which is incorporated by reference in its entirety including drawings.

FIELD OF THE INVENTION

This invention relates to an adjusting device for the size of a shoe, especially to an adjusting device for the size of a sliding sports shoe.

BACKGROUND

The sliding sports shoes in the prior art, such as ice skates, roller skates and ski boots, are worn by slipping directly into the shoe-case of the sports shoes without taking off the original shoes or boots. The shoe-case is composed mainly of a shoe head with a container groove in cylinder shape and a shoe body fixed to the shoe head with bolts. When needed to adjust the size of the shoe-case the bolts can be loosened and moved inside the container groove to the required size. This kind of sizing manner usually needs an auxiliary tool and is quite troublesome.

Chinese patent ZL02200433.5 discloses an improved sliding plate shoe which is mainly composed of a front section and a rear section, which are equipped with rollers in their sides respectively, as well as a snap-in mechanism that connects the front section and the rear section. The snap-in mechanism therein is composed of a disc bottom cover which is firmly fixed to the middle of the front section, a snap-in member which is locked above the bottom cover with bolts, and a dentiform structure which is integrated at the bottom of the rear section and snaps with the sides of the snap-in member. In addition, there are inward occluding teeth protruded underneath the snap-in member, and a spring is fixed closely against the front section at the end of the snap-in component which passes through the bottom cover. Although this kind of sizing structure has shown somewhat improvement, it is still inconvenient in adjusting. It completely depends on tactile sensation to adjust the length rather than to approach the accurate size stepwise, and the snap-in member has to be released when adjusting the length. Therefore, the existing adjusting device for shoe size needs to be further improved.

SUMMARY OF THE INVENTION

According to one aspect of the present invention, an adjusting device used to adjust the size of a sliding sports shoe is provided, which can adjust the size in a step manner by pressing directly a button on its side and can automatically lock itself.

In accordance with the present invention the adjusting device used to adjust the size of a sliding sports shoe, which includes a shoe head and a shoe body, is composed of an adjusting member for shoe size and a driving spring, in which the shoe head and the shoe body are connected to the adjusting member correspondingly and contact against the driving spring.

The adjusting member for shoe size includes a slide block placed at the bottom of the shoe head and a sliding groove built at the bottom of the shoe body. The slide block is placed inside the sliding groove. In the middle of the slide block there is a through groove. At one lateral side of the slide block locates an adjusting positioning structure for shoe size, while at the other lateral side of the slide block locates a corresponding locking groove. There are also a connection rod, a locking block, a locking spring and a button which matches with the adjusting positioning structure for shoe size. The button is installed in a bracket placed at one side of the sliding groove, while the locking block and locking spring are correspondingly installed in a bracket placed at the other side of the sliding groove. The two ends of the locking spring press against the locking block and shoe body respectively. The connection rod passes through the through groove in the middle of the slide block and connects firmly with the button and the locking block.

A pin is built on one of the ends of the slide block, especially on the front end of the slide block, and the driving spring is housed on that pin.

The adjusting positioning structure placed at one lateral side of the slide block can be, for example, snapping teeth for adjusting shoe size.

The button includes a primary button body, a lockpin, and a lockpin spring. The working part of the lockpin is a wedge-shaped part with its slope facing against the skewed tooth surface of the snapping teeth. The connection part of the lockpin presses against the lockpin spring installed inside the button.

The lateral sides of the locking groove include a sliding surface for adjusting shoe size and a locking surface, where the sliding surface for adjusting shoe size is a bevel surface with its inclining direction matching with the skewed tooth surface of the snapping teeth, and where the locking surface is a surface which is approximately perpendicular to the sliding direction of the slide block.

The locking surface of the locking groove is staggered with the straight tooth surface of the snapping teeth for adjusting shoe size.

The tooth pitch of the snapping teeth is in the range of 5-15 mm.

The obliquity of the sliding surface of the locking groove is 0°-60°, preferably 10°-60°, while the depth of the locking groove is in the range of 3-16 mm.

The cross section of the button can be in a drum shape.

This device in accordance with the present invention can be also equipped with a locking block for the button with its cross section same as that of the button. The locking block for the button can be rotatablely mounted on the outside of the button itself.

According to another aspect of the present invention, a sliding sports shoe is provided, in which it is equipped with the above described adjusting device.

One advantage of the adjusting device for shoe size in this invention is that the shoe size can be adjusted in a direct and stepwise manner by pressing the side of this adjusting device with automatic locking.

DETAILED DESCRIPTION OF THE PREFERRED EMBODIMENTS

The present invention is further described in details with the attached drawings and specific examples.

Figure 1:
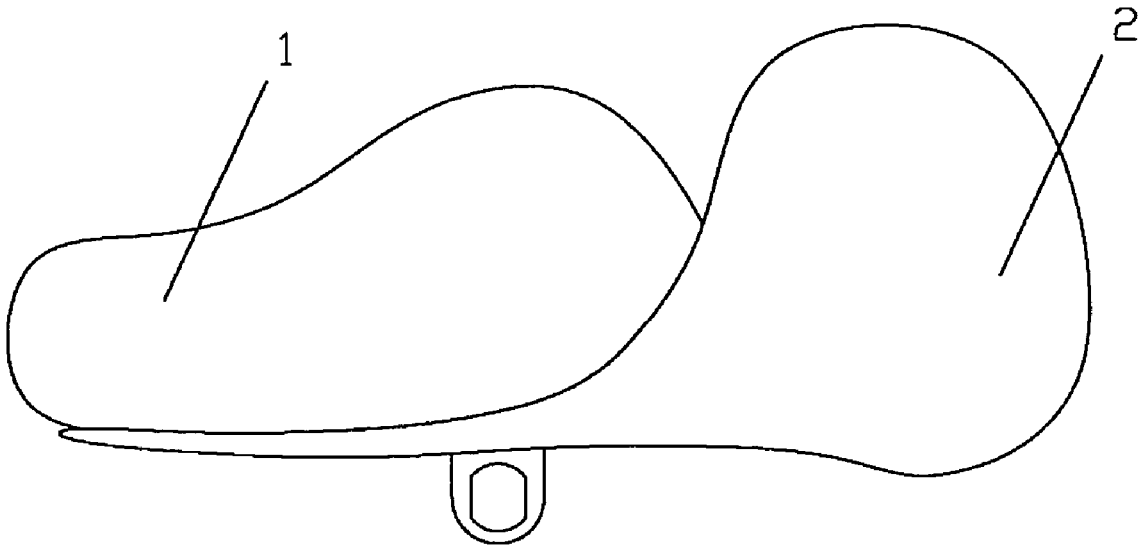
FIG. 1 is the schematic view of a sliding sports shoe with an adjusting device of the present invention.
Figure 2:
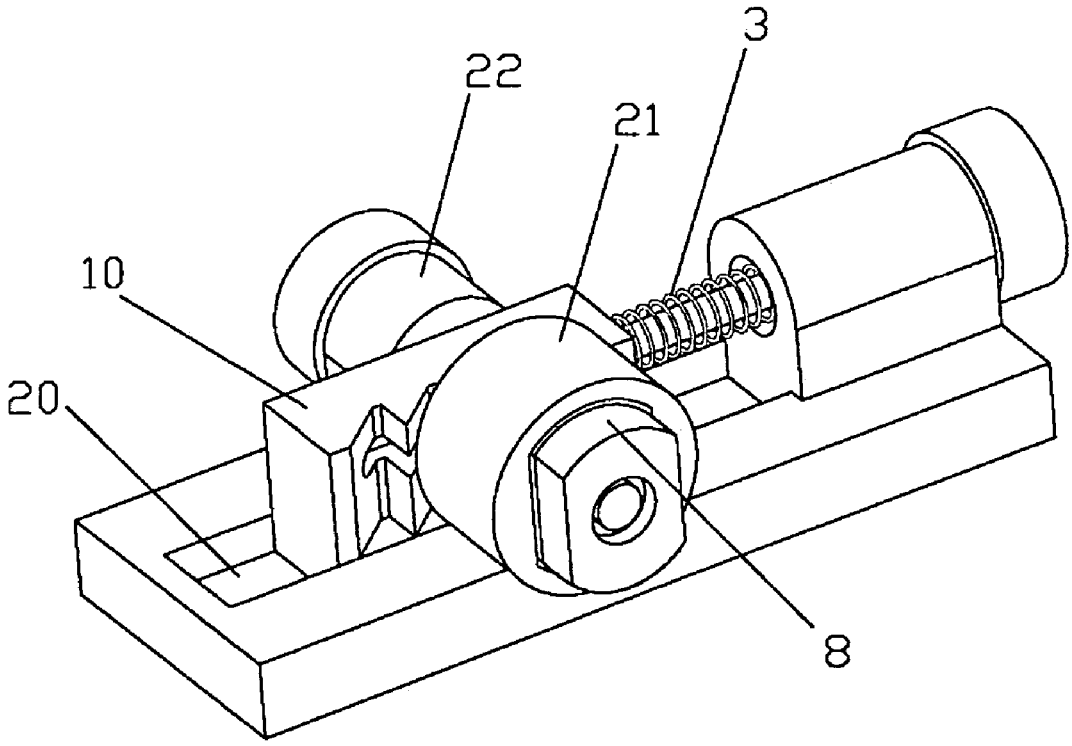
FIG. 2 is the perspective view of the structure of an adjusting device in one embodiment in accordance with the present invention.
Figure 3:
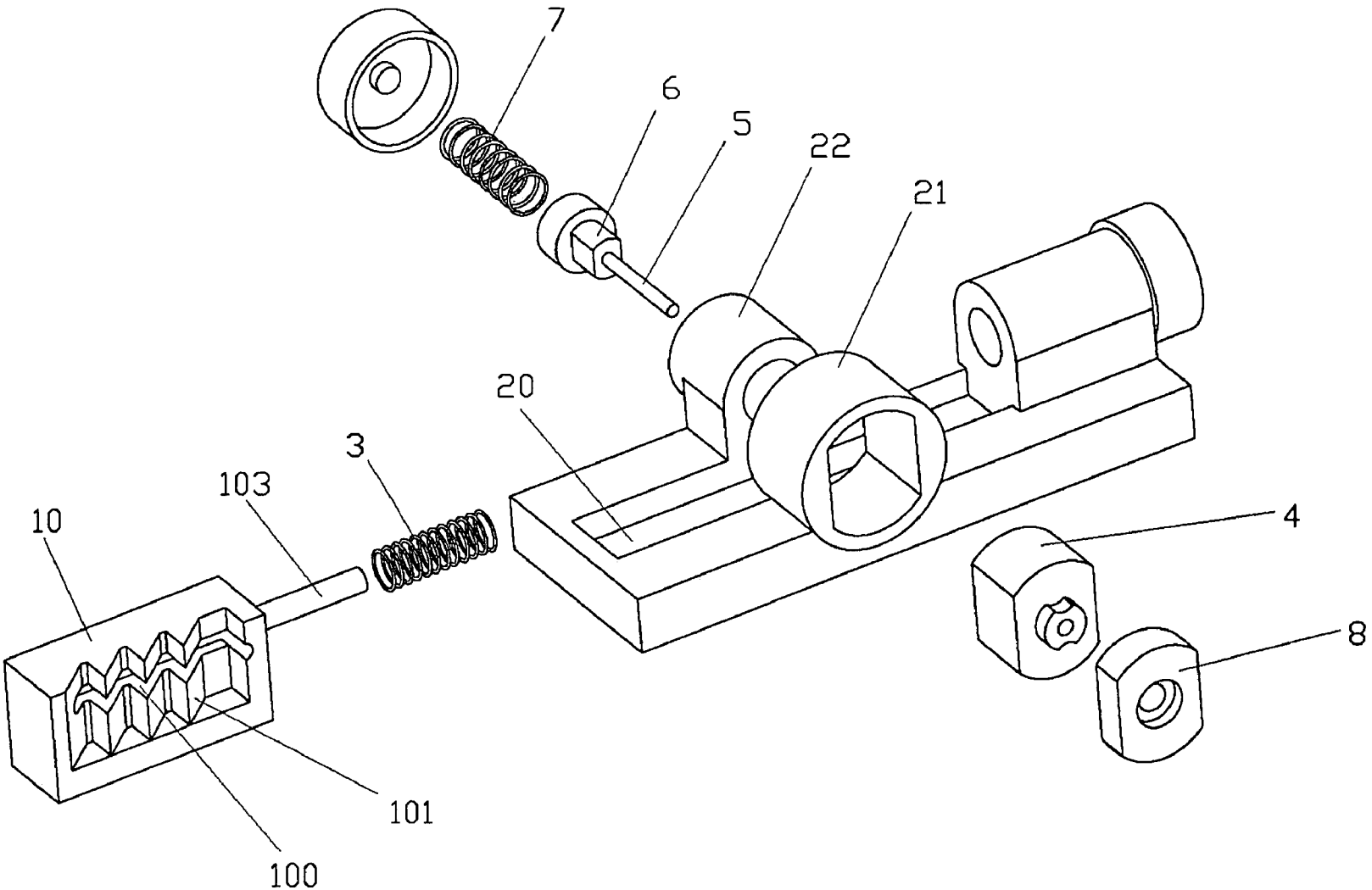
FIG. 3 is the perspective explosion view of the structure of the adjusting device in FIG. 2 (viewing at angle 1).
Figure 4:
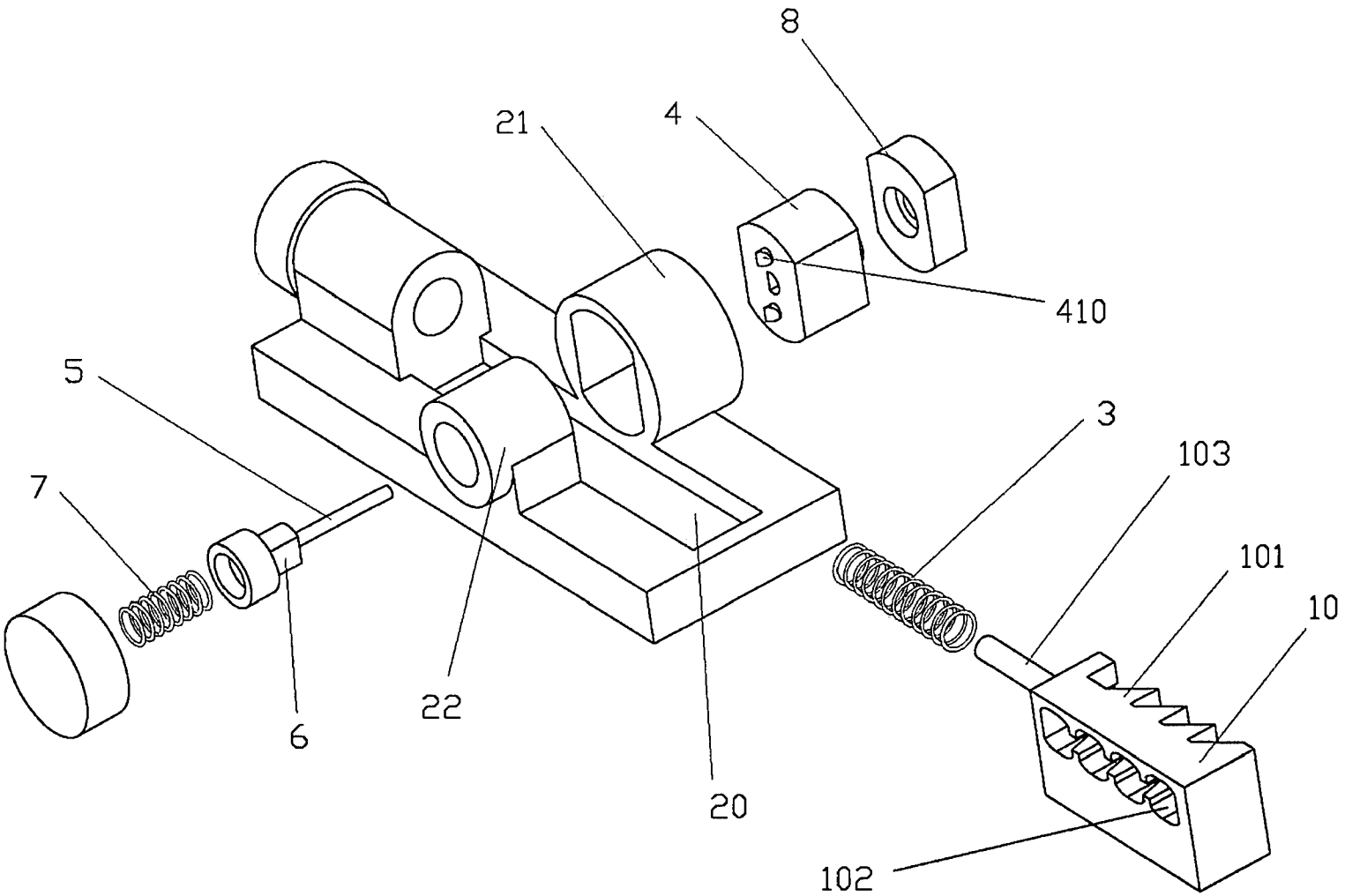
FIG. 4 is the perspective explosion view of the structure of the adjusting device in FIG. 2 (viewing at angle 2).
Figure 5:
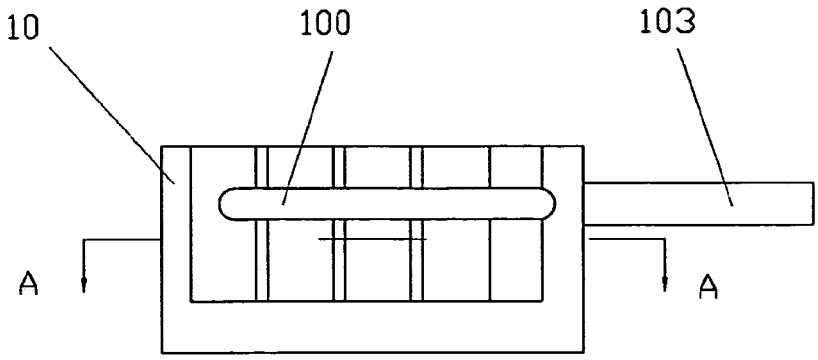
FIG. 5 is the front view of a slide block in one embodiment in accordance with the present invention.
Figure 6:
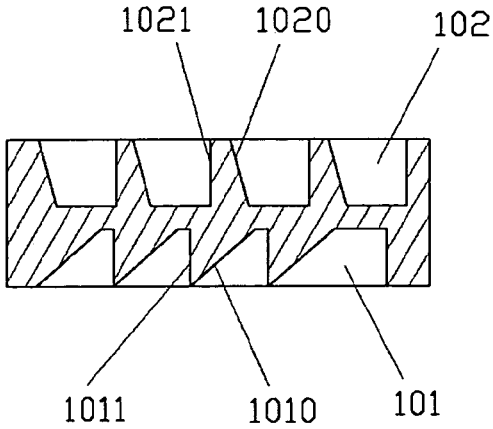
FIG. 6 is the A-A section view of the slide block in FIG. 5.
Figure 7:
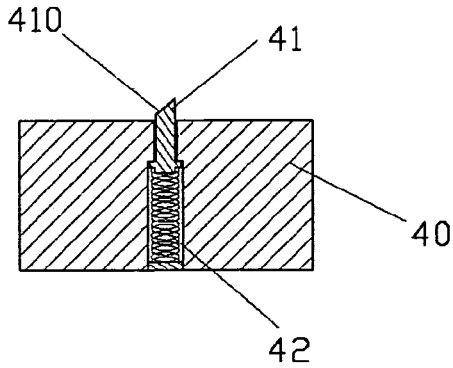
FIG. 7 is the section view of a button in one embodiment in accordance with the present invention.

FIGS. 1-7 depict an adjusting device used to adjust the size of a sliding sports shoe in accordance with the present invention. The sliding sports shoe includes a shoe head 1 and a shoe body 2. The adjusting device for shoe size includes an adjusting member and a driving spring 3, where the shoe head 1 and shoe body 2 are connected correspondingly to the adjusting member and touch against the driving spring 3.

The adjusting member includes a slide block 10 placed at the bottom of the shoe head 1 and a sliding groove 20 built at the bottom of the shoe body 2. The slide block 10 is placed inside the sliding groove 20. In the middle of the slide block 10 there is a through groove 100. At one lateral side of the slide block 10 locates an adjusting positioning structure, while at the other lateral side of the slide block 10 locates a corresponding locking groove 102. The adjusting member also includes a connection rod 5, a locking block 6, a locking spring 7, and a button 4 which matches with the above adjusting positioning structure. The button 4 is installed in a bracket 21 placed at one side of the sliding groove 20, while the locking block 6 and the locking spring 7 are correspondingly installed in another bracket 22 at the other side of the sliding groove 20. The two ends of the locking spring 7 press against the locking block 6 and the shoe body 2 respectively. The connection rod 5 passes through the through groove 100 in the middle of the slide block 10 and is fixed to the button 4 and the locking block 6.

A pin 103 is built on the front end of the slide block 10, and the driving spring 3 is housed on the pin 103.

The adjusting positioning structure placed at one lateral side of the slide block 10 can be snapping teeth 101 for adjusting shoe size.

The button 4 includes a primary button body 40, a lockpin 41 and a lockpin spring 42. The working part of the lockpin 41 presents a wedge-shaped part with its slope 410 facing against the skewed tooth surface 1010 of the snapping teeth 101. The connection part of the lockpin 41 presses against the lockpin spring 42 which is installed inside the primary button body 40.

The lateral sides of the locking groove 102 include a sliding surface 1020 for adjusting shoe size and a locking surface 1021, where the sliding surface 1020 is a bevel surface with its inclining direction matching with the skewed tooth surface 1010 of the snapping teeth 101, and where the locking surface 1021 is a surface which is approximately perpendicular to the sliding direction of the slide block 10.

The locking surface 1021 of the locking groove 102 is staggered with the straight tooth surface 1011 of the snapping teeth 101.

The tooth pitch of the snapping teeth 101 can be in the range of 5-15 mm. The obliquity of the sliding surface 1020 of the locking groove 102 can preferably be in the range of 10°-60°, more preferably 15°-50°. The depth of the locking groove 102 can be in the range of 3-16 mm. The cross section of the button 4 can be in a drum shape.

The above adjusting device is also equipped with a locking block 8 for the button with its cross section same as that of the button 4. The locking block 8 for the button is rotatablely mounted on the outside of the button 4 itself.

As described above, the present invention provides an adjusting device with the driving spring 3 to adjust the size of a sliding sports shoe rather than by manual pushing and pulling. By pushing the button 4 automatic adjusting and locking of shoe size can be realized in an easy and convenient way.

From the forgoing, it will be appreciated that specific embodiments of the present invention have been described herein for purpose of illustration, but that various modifications maybe made without deviating from the spirit and scope of the invention. Accordingly, the present invention is not limited except as by the appended claims.

What is claimed is:

1. An adjusting device used to adjust the size of a sliding sports shoe, said sliding sports shoe includes a shoe head and a shoe body, wherein said adjusting device is composed of:

an adjusting member for shoe size including a slide block placed at the bottom of said shoe head and a sliding groove built at the bottom of said shoe body, and a driving spring, wherein said adjusting member is correspondingly connected to said shoe head and said shoe body, said driving spring is pressed against said shoe head and said shoe body, said slide block is placed inside said sliding groove, and the adjusting of shoe size is reached by sliding said slide block in said sliding groove, and wherein a through groove locates at the middle of said slide block, an adjusting positioning structure locates at one lateral side of said slide block, and a corresponding locking groove locates at the other lateral side of said slide block.

2. The adjusting device according to claim 1, wherein said adjusting member further includes a connection rod, a locking block, a locking spring and a button which matches with said adjusting positioning structure for shoe size, said button is installed in a bracket placed at one side of said sliding groove, said locking block and locking spring are correspondingly installed in a bracket placed at the other side of said sliding groove, the two ends of said locking spring press against said locking block and said shoe body respectively, and said connection rod passes through said through groove and connects firmly with said button and said locking block.

3. The adjusting device according to claim 2, wherein on the front end of said slide block is built a pin and said driving spring is used to be housed on that pin.

4. The adjusting device according to claim 1, wherein said adjusting positioning structure is snapping teeth for adjusting shoe size.

5. The adjusting device according to claim 4, wherein said button includes a primary button body, a lockpin and a lockpin spring installed inside the button, the working part of said lockpin is a wedge-shaped part with its slope facing against the skewed tooth surface of said snapping teeth, and the connection part of said lockpin presses against said lockpin spring.

6. The adjusting device according to claim 4, wherein the lateral sides of said locking groove include a sliding surface for adjusting shoe size and a locking surface, said sliding surface is a bevel surface with its inclining direction matching with the skewed tooth surface of said snapping teeth, and said locking surface is a surface which is approximately perpendicular to the sliding direction of said slide block.

7. The adjusting device according to claim 6, wherein said locking surface of said locking groove is staggered with the straight tooth surface of said snapping teeth.

8. The adjusting device according to claim 6, wherein the tooth pitch of said snapping teeth is in the range of 5-15 mm.

9. The adjusting device according to claim 6, wherein the obliquity of said sliding surface of said locking groove is 10°-60°.

10. The adjusting device according to claim 6, wherein the depth of said locking groove is in the range of 3-16 mm.

11. The adjusting device according to claim 2, wherein a locking block for said button is rotatablely mounted on the outside of said button.

* * * * *